US010309625B2

(12) United States Patent
Sattler

(10) Patent No.: US 10,309,625 B2
(45) Date of Patent: Jun. 4, 2019

(54) LAMP

(71) Applicant: Ulrich Sattler, Heiningen (DE)

(72) Inventor: Ulrich Sattler, Heiningen (DE)

( * ) Notice: Subject to any disclaimer, the term of this patent is extended or adjusted under 35 U.S.C. 154(b) by 0 days.

(21) Appl. No.: 15/385,990

(22) Filed: Dec. 21, 2016

(65) Prior Publication Data

US 2017/0211787 A1 Jul. 27, 2017

(30) Foreign Application Priority Data

Jan. 26, 2016 (DE) ..... 10 2016 101 353
Feb. 2, 2016 (DE) ..... 10 2016 101 769

(51) Int. Cl.

| | |
|---|---|
| ***F21S 2/00*** | (2016.01) |
| ***F21S 6/00*** | (2006.01) |
| ***F21S 8/04*** | (2006.01) |
| ***F21V 7/00*** | (2006.01) |
| ***F21V 19/02*** | (2006.01) |
| ***F21V 21/03*** | (2006.01) |
| ***F21V 23/00*** | (2015.01) |
| ***F21V 23/06*** | (2006.01) |
| ***F21Y 105/18*** | (2016.01) |
| ***F21Y 115/10*** | (2016.01) |
| ***F21Y 115/15*** | (2016.01) |

(52) U.S. Cl.

CPC ..... *F21V 19/02* (2013.01); *F21S 2/005* (2013.01); *F21S 6/004* (2013.01); *F21S 6/008* (2013.01); *F21S 8/043* (2013.01); *F21V 7/0016* (2013.01); *F21V 21/03* (2013.01); *F21V 23/002* (2013.01); *F21V 23/005* (2013.01); *F21V 23/06* (2013.01); *F21Y 2105/18* (2016.08); *F21Y 2115/10* (2016.08); *F21Y 2115/15* (2016.08)

(58) Field of Classification Search

CPC .... F21S 2/005; F21S 6/00; F21S 8/043; F21S 8/08; F21S 6/008; F21V 21/06; F21V 21/08; F21V 21/096; F21V 21/26; F21V 21/29; F21V 23/005; F21V 23/06; F21Y 2103/10; F21Y 2105/10

See application file for complete search history.

(56) References Cited

U.S. PATENT DOCUMENTS

| | | | | |
|---|---|---|---|---|
| 2,338,078 A * | 12/1943 | Wood | F21L 15/02 | 362/187 |
| 4,538,214 A * | 8/1985 | Fisher | F21V 21/096 | 362/147 |
| 4,719,549 A * | 1/1988 | Apel | F21S 2/00 | 362/398 |
| 4,949,226 A * | 8/1990 | Makita | B60Q 1/0041 | 362/538 |
| 6,170,967 B1 * | 1/2001 | Usher | F21V 23/06 | 200/227 |
| 6,220,736 B1 * | 4/2001 | Dobler | F21S 41/28 | 362/539 |

(Continued)

*Primary Examiner* — Alexander K Garlen
(74) *Attorney, Agent, or Firm* — Michael Soderman

(57) ABSTRACT

The invention relates to a lamp with at least one lamp head and a base unit that each have a modular design to the effect that the lamp head can embody different geometric, optical and electronic configurations and the base unit can embody different geometric configurations. The lamp head has a retaining element that can be fastened via magnetic forces so as to be adjustable in terms of position to a holder of the base unit.

16 Claims, 8 Drawing Sheets

(56) References Cited

U.S. PATENT DOCUMENTS 6,406,171 B1 * 6/2002 Satsukawa ..... F21S 43/40 362/518
6,592,241 B1 * 7/2003 Kovacik ..... F16M 11/10 362/275
6,663,266 B2 * 12/2003 Huang ..... F16M 11/2064 362/33
7,538,289 B2 * 5/2009 Carroll ..... B60H 1/3442 200/277
8,210,706 B2 * 7/2012 Rooymans ..... F21S 8/086 362/153.1
8,424,833 B2 * 4/2013 Muller ..... F16M 11/08 248/324
8,602,609 B2 * 12/2013 Yun ..... F21V 29/51 362/294
9,470,407 B2 * 10/2016 Abel ..... B64F 1/205
9,709,258 B2 * 7/2017 Rudisill ..... H05K 3/325
9,765,921 B2 * 9/2017 Vogel ..... F16M 11/14
2002/0163807 A1 * 11/2002 Lee ..... F21S 6/003 362/253
2003/0160142 A1 * 8/2003 Brahler ..... E04B 9/006 248/317
2004/0070990 A1 * 4/2004 Szypszak ..... G01N 21/8806 362/555
2006/0262523 A1 * 11/2006 Smith ..... F21L 4/085 362/157
2008/0019124 A1 * 1/2008 Smith ..... F21L 4/085 362/183
2009/0303715 A1 * 12/2009 Takasago ..... F21S 8/086 362/235
2012/0236559 A1 * 9/2012 Sachsenweger ..... F21K 9/00 362/235
2012/0320626 A1 * 12/2012 Quilici ..... F21S 8/04 362/606
2013/0088871 A1 * 4/2013 Yun ..... F21V 3/0436 362/249.01
2013/0286646 A1 * 10/2013 Snell ..... F21V 13/04 362/231
2013/0335980 A1 * 12/2013 Nakasuji ..... F21S 8/026 362/341
2016/0003464 A1 * 1/2016 Thomas ..... F21V 15/01 362/244
2016/0044217 A1 * 2/2016 Richardson ..... H04N 5/2256 348/207.11

* cited by examiner

LAMP

CROSS REFERENCE TO RELATED APPLICATIONS

This application claims the priority of DE 102016101353.6 filed on 2016 Jan. 26 and the priority of DE 102016101769.8 filed on 2016 Feb. 2; all applications are incorporated by reference herein in their entirety.

BACKGROUND

The invention relates to a lamp.

Lamps of the type in question serve in general to illuminate buildings or outdoor areas. In particular, and as a preference, the lamps are used to illuminate interior rooms of buildings that are utilized for private and for commercial purposes.

Furthermore, the use of lamps with LEDs (light-emitting diodes) as a light source is widely known. LEDs of that type distinguish themselves by a high level of economic efficiency. Moreover, LEDS can be flexibly mounted in lamp heads to create specific lighting scenarios.

SUMMARY

The invention relates to a lamp with at least one lamp head and a base unit that each have a modular design to the effect that the lamp head can embody different geometric, optical and electronic configurations and the base unit can embody different geometric configurations. The lamp head has a retaining element that can be fastened via magnetic forces so as to be adjustable in terms of position to a holder of the base unit.

DETAILED DESCRIPTION

Taking this prior art as a starting point, the invention is based on the problem of making a lamp available that can be manufactured in an efficient fashion and that can be adapted in a simple way in terms of its design and functionality to different application requirements.

The elements of claim 1 are specified to solve this problem. Advantageous embodiments and useful design developments of the invention are described in the subclaims.

The invention relates to a lamp with at least one lamp head and a base unit that each have a modular design to the effect that the lamp head can embody different geometric, optical and electronic configurations and the base unit can embody different geometric configurations. The lamp head has a retaining element that can be fastened via magnetic forces so as to be adjustable in terms of position to a holder of the base unit.

The basic idea of the invention is to consequently design the lamp head and the base unit as modular units so that a large number of variants of the lamp can be manufactured with very little production-related effort. The lamp as per the invention can therefore be adapted in a simple and quick way to the most diverse application requirements.

It is essential here for the lamp head to be able to embody different optical and electronic configurations; the chronological, spectral and spatial radiation behavior of light can be varied because of that in the lamp as per the invention. Moreover, different geometric configurations are possible via different shapes of the lamp head.

Furthermore, the base unit of the lamp can embody different geometric configurations. A lamp as per the invention can therefore be designed in the form of a ceiling lamp, a hanging lamp, a wall lamp or a floor lamp, and this design can have different spatial configurations; a flexible system that can be adapted to different rooms is obtained because of that.

Another important aspect of the invention is that the lamp head, or each lamp head, has a retaining element via which the lamp head can be attached to a holder of the base unit without tools; the attachment is effected with magnetic forces, preferably solely with the magnetic forces.

In addition, it is advantageous here that the retaining element can be attached to the holder in different positions; the lamp head can be put into different orientations on the base unit with little effort because of this, and different geometric configurations of the lamp can be generated in that way.

As a special advantage, the holder has a magnet with a contact surface having the shape of a spherical shell into which the retaining element of the lamp head can be inserted. The retaining element has a spherical shape to conform with that and is made of a metallic material.

The sphere-shaped retaining element can be rotated by nearly 360° in each of three spatial directions in the contact surface of the magnet with the shape of a spherical shell, so a very large adjustment range of the lamp head is obtained in the base unit.

A further advantage is that the contact point between the magnet and the retaining element has good heat conductivity, so heat created by the optical and electronic components in the lamp head can be carried off through this contact point.

In accordance with an advantageous embodiment, the lamp head has a ring; a cover can be put on top of it.

The light sources of the lamp head can be arranged in both the area of the ring and in the area of the cover; different radiation characteristics of the lamp head can be realized because of that. The cover and the ring can constitute radiation surfaces for the light emitted by the light source here. The term ring is to be understood in a general sense in connection with this, meaning that the ring can have a circular, elliptical, polygonal or similar form.

As a special advantage, the ring and the cover are made of opaque materials, so the light of the light sources is radiated from the bottom of the lamp head.

In accordance with a first variant, light sources are provided on the inside of the ring; their light is radiated through a diffusor on the bottom of the ring.

In this case, the lamp head constitutes a so-called floodlight, radiating light from the bottom in a non-directional way. The retaining element has a spherical shape to conform with that and is made of a metallic material.

In accordance with a second variant, light sources are provided on the bottom of the cover.

At least one central light source is provided on the bottom of the cover here that radiates light through a lens.

The lamp head therefore constitutes a so-called spotlight that radiates light from the bottom in a directional way.

In a useful further design form, external light sources can be additionally provided on the bottom of the cover that radiate light directly or through a diffusor after reflection at the lens.

A combination of radiation characteristics of a floodlight and a spotlight is therefore obtained.

It is useful in connection with this for the diffusor to be arranged on the bottom of the ring, and for the lens to be mounted in a central hole of the diffusor.

In accordance with an advantageous design form of the invention, the light sources are comprised of LEDs (light-emitting diodes) or OLEDs (organic light-emitting diodes).

The light sources with this type of design have a long service life and can be installed in the lamp head in virtually any spatial arrangement.

As a special advantage, light sources and the accompanying electronic components for their control are arranged on a common circuit board.

A more compact and modular structure of the light sources and the accompanying electronic components is obtained with that.

The electronic components serve in general to control the operation of the light sources. As a special advantage, the electronic components are designed to form different dimming systems.

Continuous variation between warm white light and cold white light of the light sources is possible, as an example, because of the variable dimming. The dimming can take place through external units, for instance via Bluetooth interfaces.

As a further advantage, an electrical connector is provided on the ring.

The connectors can be designed as plugs or sockets. In general, the power supply for the electronic and optical components of the lamp head can be provided through lines routed in the base unit that go to the connectors.

In accordance with an especially advantageous design form of the invention, the base unit has a modular arrangement of connecting pieces and branching elements.

The connecting pieces and branching elements can be freely chosen; the most diverse geometries of the lamp, in particular free-form surfaces, can be realized because of that. The lamp can form a flat structure running in one plane here or a three-dimensional structure. In general, the connecting pieces and branching elements have receptacles for holders to which lamp heads can be fastened such that the number and arrangement of lamp heads of the lamp can be freely chosen.

The connecting pieces and branching elements advantageously constitute hollow bodies in which electrical lines can be routed.

The power supply lines for the lamp heads are therefore routed in the interior of the base unit and consequently do not interfere with the overall visual impression of the lamp.

In accordance with an advantageous design form, the connecting pieces each run along a straight line.

Furthermore, the branching elements each have a number of branch segments.

Different branching elements are made up of different quantities and different spatial orientations of branch segments here.

A modular system is therefore obtained with which the most diverse geometric configurations of the lamp can be realized.

DETAILED DESCRIPTION OF THE PREFERRED EMBODIMENTS

Figure 1:
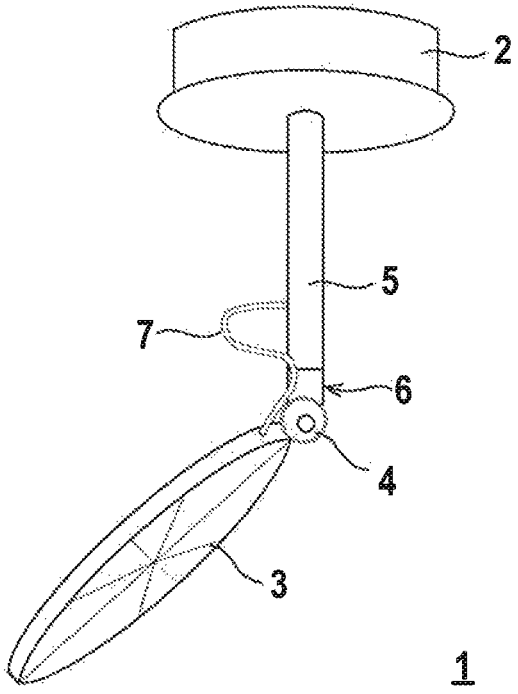
FIG. 1: First example of the lamp as per the invention.

FIG. 1 shows a first example of the lamp 1 as per the invention. The lamp 1 is designed in the form of a spotlight emitting directional light that is mounted with a ceiling bracket 2 on a ceiling of a room of a building. The lamp 1 is comprised of a lamp head 3; a ball-shaped retaining element 4 is laterally provided on this. The lamp head 3 is adjustably fastened to a base unit of the lamp 1 with this retaining element 4. The base unit is comprised of a connecting piece 5 and a holder 6 mounted at the bottom of the connecting piece 5; the retaining element 4 is mounted on the holder.

The connecting piece 5 is made of a hollow body running in a straight line. A line 7 supplying power to the lamp head 3 is routed in the interior of the hollow body. The line 7 runs to an opening of the branch segment 20 here, so it can be connected to the lamp head 3.

Figure 2A:
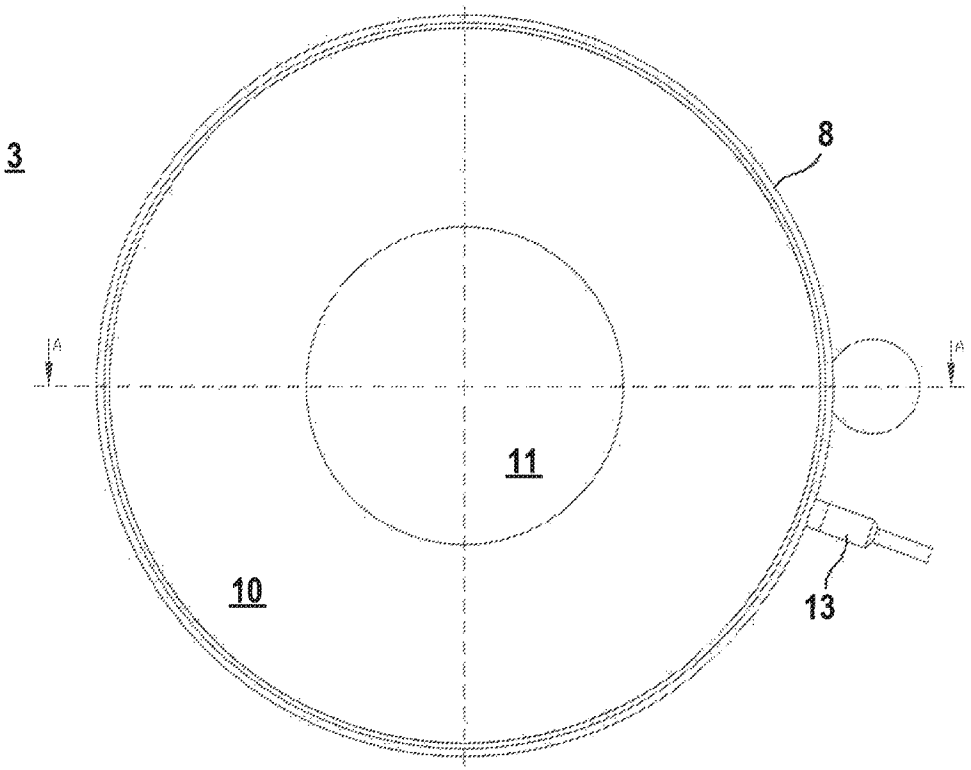
FIG. 2A: Lamp head for the lamp as per the invention in a view from the bottom.
Figure 2B:
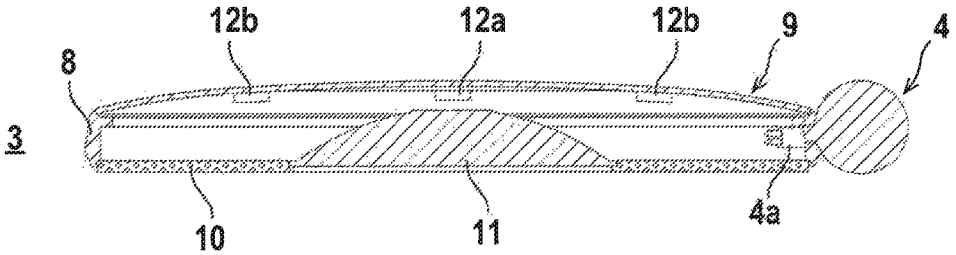
FIG. 2B: Lamp head for the lamp as per the invention in a sectional view.

FIGS. 2A and 2B show the lamp head 3 in individual diagrams. The individual components of the lamp head 3 are shown in FIG. 2C.

Figure 2C:
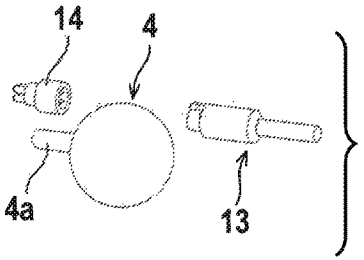
FIG. 2C: Individual diagram of the components of the lamp head.
Figure 2C:
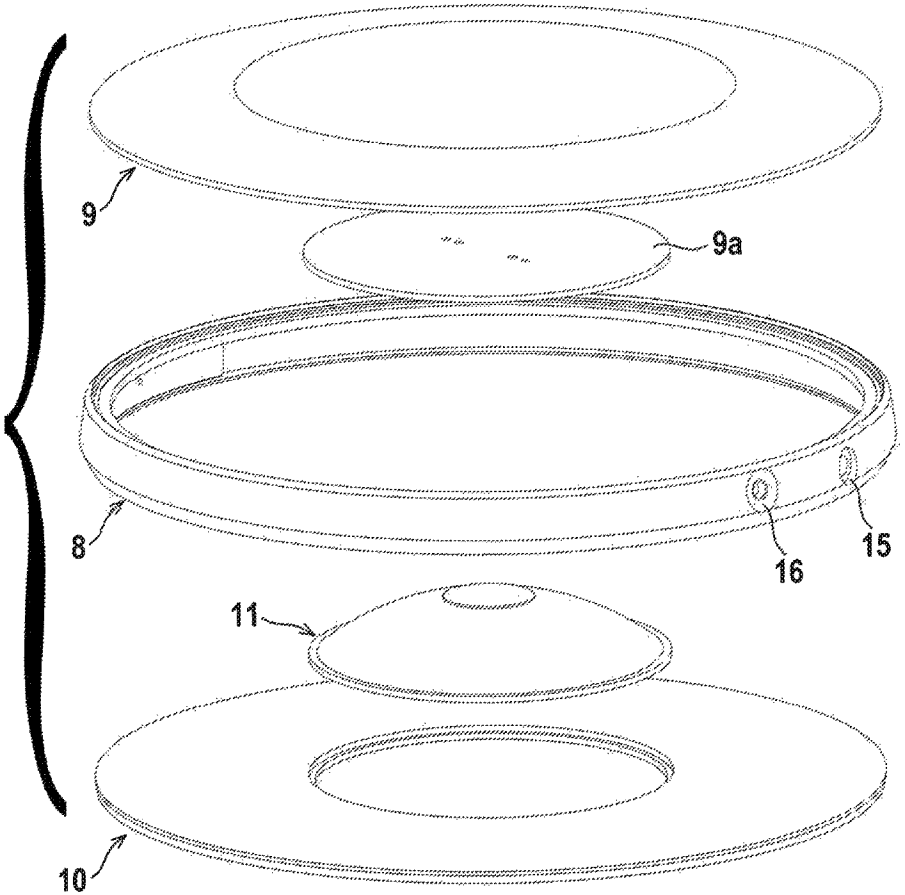

As evident in FIG. 2C, the lamp head 3 has a circular ring 8. This ring 8 is comprised of a material that is impenetrable to light such as plastic or metal. A cover 9 can be put on top of the ring 8. The cover 9, which is chosen to be slightly convex, is likewise comprised of a material that is impenetrable to light. The optical appearance of the lamp head 3 can be varied by changing the colors and the surface characteristics of the ring 8 and the cover 9. A carrier 9*a* that is designed to hold light sources can be attached to the bottom of the cover 9.

The light is radiated through the bottom of the lamp head 3. The bottom is terminated with a diffusor 10 and a lens 11; the lens 11 is inserted into a central hole of the diffusor 10.

LEDs (light-emitting diodes) 12*a*, 12*b* are arranged as light sources on the bottom of the shielding. Alternatively, OLEDs (organic light-emitting diodes) can also be used.

As evident from FIG. 2*a*, first LEDs 12*a* are directly arranged above the lens 11. The light rays radiated from these LEDs 12*a* are bundled through the lens 11 and consequently radiated in a directional fashion, meaning the radiation characteristics of a spotlight are obtained.

External LEDs 12*b* that are preferably arranged in a ring are also provided in addition to these central LEDs 12*a*. The light rays from these LEDs 12*b* are indirectly emitted, after reflection at the lens 11, or directly emitted, via the diffusor 10, towards the outside and provide for a non-directional radiation component.

The general, the LEDs 12*a*, 12*b* are arranged together with their electronic components on circuit boards. The light sources can be dimmed, in particular, with the electronic components.

The lamp head 3 of FIGS. 2A-C can be converted to the effect that the light sources are arranged on the interior wall of the ring 8. Otherwise, the lamp head 3 has the same structure as the lamp head 3 of FIGS. 2A-C. Alternatively, a lens 11 is not provided on the bottom of the lamp head 3, but instead a diffusor 10 that covers the entire bottom. In this case, the lamp head 3 constitutes a floodlight that only radiates non-directional light.

As evident from FIG. 2C, the lamp head 3 has, as a possible electrical connector, a plug 13 and a socket 14, which can optionally be inserted into a cut-out section 15 in the ring 8. In the example of FIGS. 2A and 2B, a plug 13 is provided as an electrical connector; power is supply through it to the optical and electrical components of the lamp head 3.

A metallic, ball-shaped retaining element 4 is provided for the lamp head 3 of FIGS. 2A-C, as is the case with all of the lamp heads 3 of the lamp 1, for the adjustment and lighting of the lamp head 3 on the base unit of the lamp 1. This retaining element 4 has a cylindrical connection piece 4*a* that can be inserted into a further cut-out section 16 of the ring 8; the retaining element 4 is laterally fastened to the lamp head 3 through that.

Figure 3:
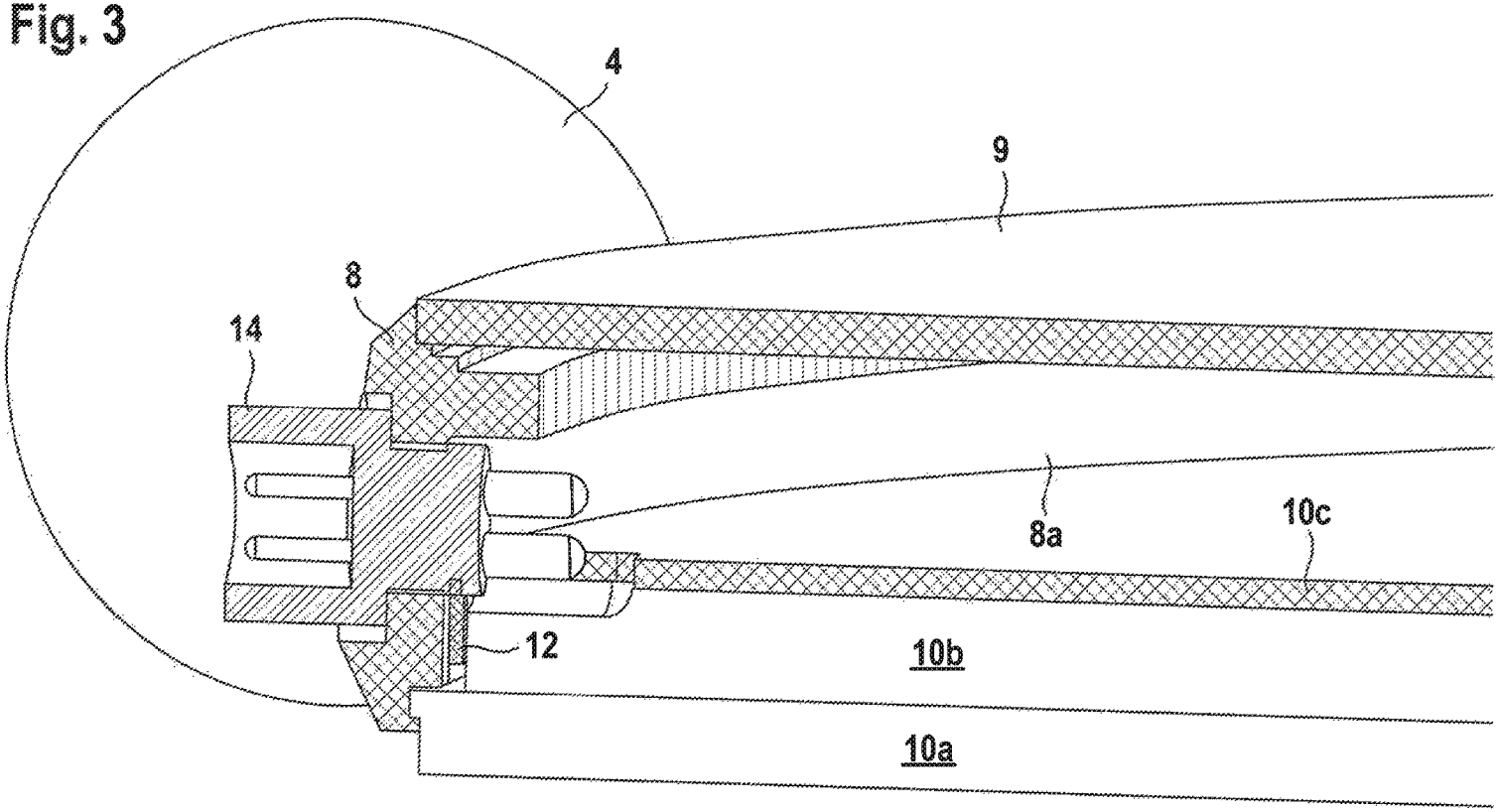
FIG. 3: Variant of the lamp head in accordance with FIGS. 2A to 2C.

FIG. 3 shows a partial representation of a variant of the lamp head 3 of FIGS. 2A-C. The lamp head 3 in accordance with FIG. 3 has a ring 8 once again in which a plug 14 and the ball-shaped retaining element 4 are laterally mounted as electrical connectors. The cover 9, which has a disk shape in this case, is provided on the ring 8 once again A flat board 8*a* that supports LEDs 12 as light sources is provided in the interior of the ring 8 in this case instead of the carrier 9*a*.

The bottom of the lamp head 3 is terminated with a multi-layer structure made up of several plate-shaped elements loosely put on top of one another instead of the diffusor 10. The lower layer 10*a* and the middle layer 10*b* are made of a transparent material, in particular acrylic. The top layer 10*c* is made of an opaque material that is, in particular, a white material with printing on the bottom if applicable.

Figure 4:
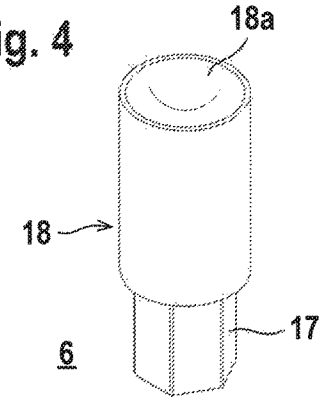
FIG. 4: Holder for the lamp as per the invention.

The retaining element 4 of the lamp head 3 can be adjustably mounted in a holder 6. The holder 6 is shown in an individual diagram in FIG. 4.

The holder 6 has a connection part 17 with a polygonal cross-section at its rear end. The holder 6 can be fastened to a component of the base unit, to the connecting piece 5 in the example of FIG. 1, with this connection part 17.

Furthermore, the holder 6 has a magnet 18; the free front side of the magnet 18 has a contact surface 18*a* with the shape of a spherical shell. The radius of the contact surface 18*a* corresponds to the radius of the ball-shaped retaining element 4, so the retaining element 4 is held in a positive-locking way in the contact surface 18 and fixed in place with magnetic forces. The contact surface 18*a* can be supplied with a diamond coating to increase the frictional forces. Because of the spherical symmetry of the contact surface 18*a* and the retaining element 4, the retaining element 4 and therefore the overall lamp head 3 can be rotated by nearly 360° in each of three spatial directions and can consequently be fixed in place on the holder 6 in nearly any adjustment position.

Figure 5A:
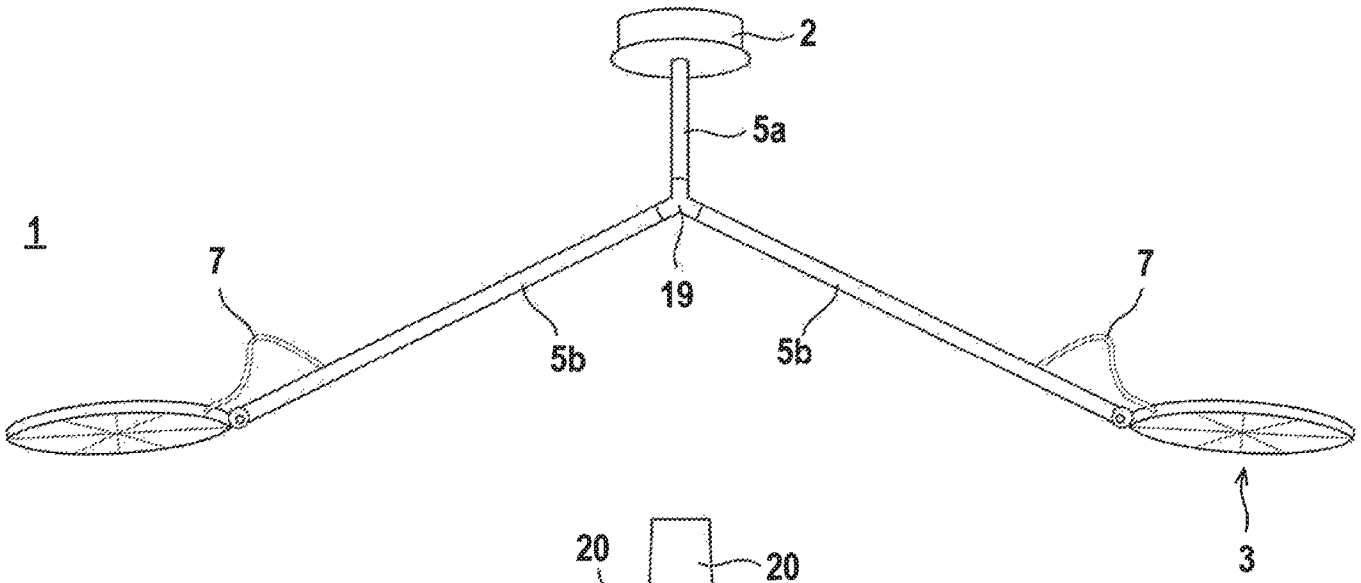
FIG. 5A: Second example of the lamp as per the invention.

FIG. 5A shows a further example of a lamp 1. This lamp 1 is designed as a ceiling lamp once again and is fastened to a ceiling of a room of a building via a ceiling bracket 2.

Figure 5B:
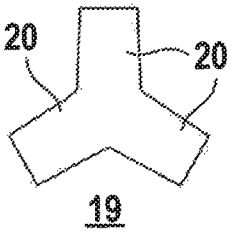
FIG. 5B: Branching element for the lamp in accordance with FIG. 5A.

The base unit of the lamp 1 is comprised in this case of three connecting pieces 5*a*, 5*b* running in straight lines and a branching element 19 that is shown in an individual diagram in FIG. 5A. This branching element 19 is designed, like the connecting pieces 5*a*, 5*b*, in the form of a hollow body, so electrical lines 7 can be routed in it. The branching element 19 has, as FIG. 5B shows, three identical branch segments 20 offset by 120° in each case; a connecting piece 5 can be fastened to each branch segment 20. In general, different branching elements 19 with different quantities and orientations of branch segments 20 can be provided for the lamp 1.

As shown in FIG. 5A, one end of a first connecting piece 5*a* is fastened to the ceiling bracket 2 and the other end is connected to a branch segment 20. Two further connecting pieces 5*b* are fastened to the two further branch segments 20 of the branching element 19; a holder 6 is fastened to their free ends in each case. A lamp head 3 is adjustably attached to this holder 6 in each case; the lamp heads 3 correspond to the embodiment in accordance with FIGS. 2A-C.

Figure 6:
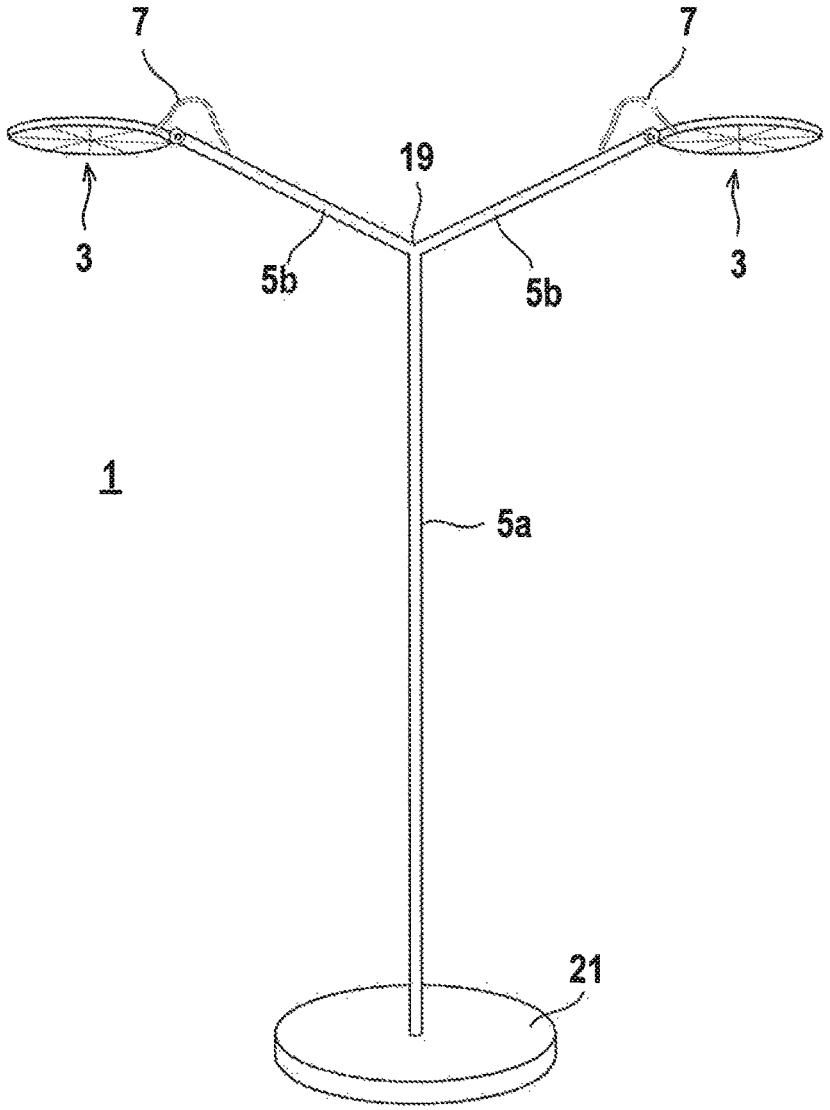
FIG. 6: Third example of the lamp as per the invention.

FIG. 6 shows another example of the lamp 1 as per the invention. The lamp 1 is designed as a floor lamp in this case. The lamp 1 in accordance with FIG. 6 is comprised of three connecting pieces 5*a*, 5*b*, which are connected via a branching element 19 in accordance with FIG. 5B. A first connecting piece 5*a* is mounted on a stand base 21 that is set up on the floor of a room or a building. A lamp head 3 is mounted in each case to the two other connecting pieces 5*b*. An electric ballast can be integrated into the stand base 21.

Figure 7A:
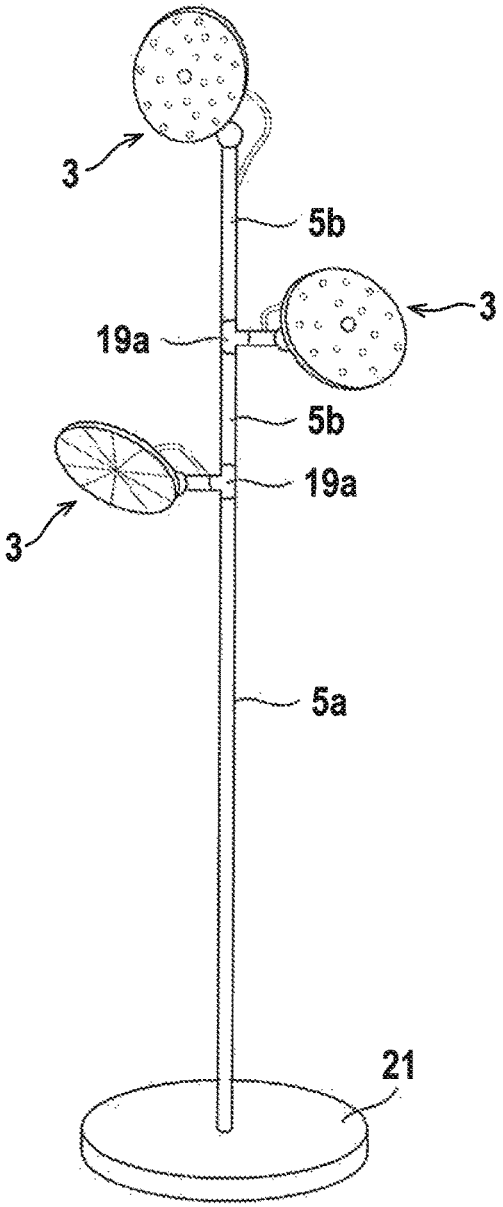
FIG. 7A: Fourth example of the lamp as per the invention.
Figure 7B:
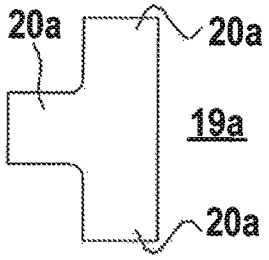
FIG. 7B: Branching element for the lamp in accordance with FIG. 7A.

FIG. 7A shows a further example of a lamp 1 designed in the form of a floor lamp. The lamp 1 is comprised of three connecting pieces 5*a*, 5*b* that are connected in pairs via branching elements 19*a*, as shown in FIG. 7B. These branching elements 19*a* have three branch segments 20*a*; two branch segments 20*a* are offset by 180° and therefore arranged along a straight line and a third branch segment 20*a* is perpendicular to this branch segment 20*a*, meaning that it is arranged at a 90° offset to it in each case. The linear arrangement of connecting pieces 5*a*, 5*b* shown in FIG. 7A is obtained with this branching element 19*a*; the connecting piece 5*a* is mounted on a stand base 21. A holder 6 for attachment of a lamp head 3 ends in each case at a branch segment 20*a* of a branching element 19*a*. A further lamp head 3 is provided at the upper end of the upper connecting piece 5*b*.

Figure 8:
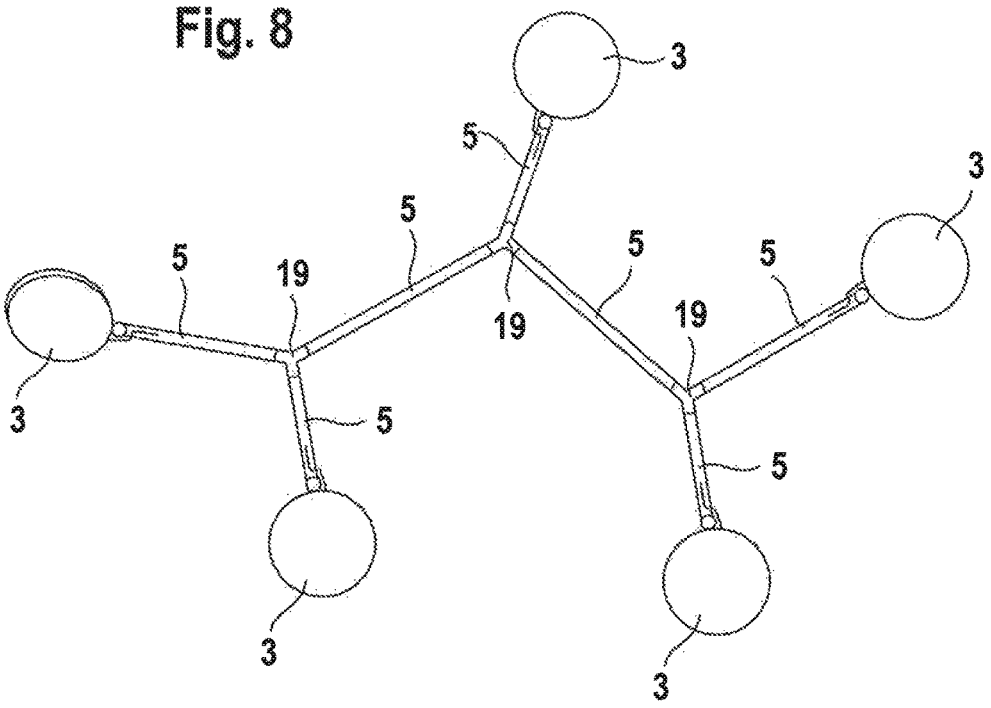
FIG. 8: Fifth example of the lamp as per the invention.

FIG. 8 shows a further example of a lamp 1. This lamp 1 is designed in the form of a ceiling lamp. The lamp 1 is comprised of a total of seven connecting pieces 5 with different lengths in part as the base unit. The connecting pieces 5 are connected via branching elements 19 in accordance with FIG. 5B to form a reticular network structure running in one plane. A lamp head 3 is located in each case at the free ends of five connecting pieces 5. This overall design can be suspended from a ceiling with steel cables that are not shown; the steel cables can be used to supply electrical power to the lamp heads 3.

LIST OF REFERENCE NUMERALS (1) Lamp
(2) Ceiling bracket
(3) Lamp head
(4) Retaining element
(4*a*) Connection piece (5) Connecting piece
(5*a*, 5B) Connecting piece
(6) Holder
(7) Line
(8) Ring
(8*a*) Flat board
(9) Cover
(9*a*) Carrier
(10) Diffusor
(10*a*) Lower layer
(10*b*) Middle layer
(10*c*) Upper layer
(11) Lens
(12*a*, 12*b*) LED
(13) Plug
(14) Socket
(15) Cut-out section
(16) Cut-out section
(17) Connection part
(18) Magnet
(18*a*) Contact surface
(19) Branching element
(19*a*) Branching element
(20) Branch segment
(20*a*) Branch segment
(21) Stand base

The invention claimed is:

1. A lamp comprising at least one lamp head and a base unit, each having a modular structure to the effect that the lamp head can embody different geometrical, optical and electronic configurations and the base unit can embody different geometric configurations, wherein the lamp head has a retaining element that is fastened to a holder of the base unit via magnetic forces so as to be adjustable in terms of position to the holder, wherein the base unit has a modular arrangement of connecting pieces and branching elements, wherein the connecting pieces and the branching elements comprise hollow bodies into which electrical lines are routed, wherein central and external light-emitting diodes are provided as light sources, said central light-emitting diodes being arranged directly above a lens such that emitted light rays are bundled through the lens and outwards of the lamp in a directional fashion with characteristics of a spotlight, wherein said external light-emitting diodes are arranged in a ring such that emitted light rays from said external light-emitting diodes are directed outwards of the lamp at least partially in an indirect fashion after reflection from the lens and directly through a diffuser.

2. The lamp according to claim 1, wherein the holder has a magnet with a contact surface having the shape of a spherical shell into which the retaining element of the lamp head is inserted, wherein said retaining element has a spherical shape and is made of a metallic material.

3. The lamp according to claim 1, wherein the lamp head has a ring, wherein a cover is put on the top of said ring.

4. The lamp according to claim 3, wherein the light sources are provided on the inside of the ring, wherein the light of said light sources is radiated through a diffusor at the bottom of the ring.

5. The lamp according to claim 3, wherein the light sources are provided on the bottom of the cover.

6. The lamp according to claim 5, wherein at least one central light-emitting diode that radiates light through the lens is provided at the bottom of the cover.

7. The lamp according to claim 6, wherein said external light-emitting diodes are provided at the bottom of the cover that radiate light directly or through a diffusor after reflection at the lens.

8. The lamp according to claim 7, wherein the diffusor is arranged on the bottom of the ring and wherein the lens is mounted in a central hole of the diffusor.

9. The lamp according to claim 4, wherein the light sources are comprised of organic light-emitting diodes.

10. The lamp according to claim 9, wherein the light sources and the accompanying electronic components for their control are arranged on a common circuit board.

11. The lamp according to claim 10, wherein the electronic components form a dimmer capable of variable dimming.

12. The lamp according to claim 3, wherein an electrical connector is provided on the ring.

13. The lamp according to claim 1, wherein the connecting pieces each run along a straight line.

14. The lamp according to claim 1, wherein the branching elements each have a quantity of branch segments.

15. The lamp according to claim 14, wherein different branching elements are made up of different quantities and different spatial orientations of branch segments.

16. A lamp comprising at least one lamp head and a base unit, each having a modular structure to the effect that the lamp head can embody different geometrical, optical and electronic configurations and the base unit can embody different geometric configurations, wherein the lamp head has a retaining element that is fastened to a holder of the base unit via magnetic forces so as to be adjustable in terms of position to the holder, wherein the base unit has a modular arrangement of connecting pieces and branching elements, wherein the connecting pieces and the branching elements comprise hollow bodies into which electrical lines are routed, wherein central and external light-emitting diodes are provided as light sources, said central light-emitting diodes being arranged directly above a lens such that emitted light rays are bundled through the lens and outwards of the lamp in a directional fashion with characteristics of a spotlight, wherein said external light-emitting diodes are arranged in a ring such that emitted light rays from said external light-emitting diodes are directed outwards of the lamp at least partially in an indirect fashion after reflection from the lens and directly through a diffuser, wherein the light-emitting diodes are organic light-emitting diodes.

* * * * *